US009261291B2

(12) United States Patent
Peteri

(10) Patent No.: US 9,261,291 B2
(45) Date of Patent: Feb. 16, 2016

(54) HOT WATER HEATER AND METHOD OF SUPPLYING HOT WATER

(75) Inventor: Niels Theodoor Peteri, Rotterdam (NL)

(73) Assignee: Henri Peteri Beheer B.V., Ridderkerk (NL)

( * ) Notice: Subject to any disclaimer, the term of this patent is extended or adjusted under 35 U.S.C. 154(b) by 1219 days.

(21) Appl. No.: 12/996,644

(22) PCT Filed: Jun. 10, 2009

(86) PCT No.: PCT/NL2009/050321

§ 371 (c)(1),
(2), (4) Date: Dec. 7, 2010

(87) PCT Pub. No.: WO2009/151321

PCT Pub. Date: Dec. 17, 2009

(65) Prior Publication Data

US 2011/0073190 A1 Mar. 31, 2011

(30) Foreign Application Priority Data

Jun. 12, 2008 (NL) ..... 2001674

(51) Int. Cl.

| | |
|---|---|
| ***F24H 1/18*** | (2006.01) |
| ***F24H 9/00*** | (2006.01) |
| ***E03B 1/00*** | (2006.01) |
| ***F24D 3/08*** | (2006.01) |
| ***F24D 3/10*** | (2006.01) |
| ***B65D 25/16*** | (2006.01) |

(52) U.S. Cl.

CPC ..... *F24H 1/188* (2013.01); *Y10T 137/0318* (2015.04)

(58) Field of Classification Search

None

See application file for complete search history.

(56) References Cited

U.S. PATENT DOCUMENTS

| | | | | | |
|---|---|---|---|---|---|
| 2,695,753 | A | * | 11/1954 | Kirk, Jr. | 237/8 R |
| 3,240,394 | A | * | 3/1966 | Modderno | 222/95 |
| 3,404,664 | A | * | 10/1968 | Viessmann | 122/32 |

(Continued)

FOREIGN PATENT DOCUMENTS

| | | | |
|---|---|---|---|
| DE | 2905887 | A * | 8/1980 |
| DE | 3040450 | A1 | 5/1982 |

(Continued)

OTHER PUBLICATIONS

Notification of Reason(s) for Refusal for corresponding Japanese application No. 2011-513438, drafting date Jul. 19, 2013.

(Continued)

*Primary Examiner* — Gregory Huson
*Assistant Examiner* — Eric Gorman
(74) *Attorney, Agent, or Firm* — Steven M. Koehler; Westman, Champlin & Koehler, P.A.

(57) ABSTRACT

A hot water heater comprises a hot water tank, a supply pipe to be connected to the public water mains and a discharge pipe to be connected to a tap. The hot water tank has a circumferential wall which encloses the interior of the tank and which is provided with a heating element disposed inside the hot water tank and with a temperature control device. The circumferential wall of the tank comprises a part which is bellows-shaped so as to be deformable under pressure, thus enabling the tank to expand and contract. The bellows-shaped part of the tank wall is surrounded by a gas chamber containing a gas under pressure, which is capable of balancing the expansion of the tank. The invention further relates to a method for supplying hot water.

16 Claims, 4 Drawing Sheets

(56) References Cited

U.S. PATENT DOCUMENTS

| | | | | | |
|---|---|---|---|---|---|
| 3,613,932 | A * | 10/1971 | Yamamoto | 220/560.07 | |
| 3,695,297 | A * | 10/1972 | Ferrentino | 138/30 | |
| 4,170,981 | A * | 10/1979 | Hakata | F23D 11/00 | 126/38 |
| 4,202,470 | A * | 5/1980 | Fujii | 222/130 | |
| 4,263,498 | A * | 4/1981 | Meyers | 392/451 | |
| 4,328,843 | A * | 5/1982 | Fujii | 141/1 | |
| 4,817,830 | A * | 4/1989 | Yavorsky | 222/386.5 | |
| 5,332,121 | A * | 7/1994 | Schmidt et al. | 222/95 | |
| 5,501,012 | A * | 3/1996 | Nogles | 29/890.051 | |
| 5,522,523 | A * | 6/1996 | Nogles | 220/567.3 | |
| 5,555,997 | A | 9/1996 | Nogles | | |
| 5,673,664 | A * | 10/1997 | Lassanske | 123/196 R | |
| 5,778,679 | A * | 7/1998 | Celorier et al. | 62/47.1 | |
| 5,797,520 | A * | 8/1998 | Donahue | 222/386.5 | |
| 5,849,241 | A * | 12/1998 | Connan | 264/529 | |
| 6,041,820 | A * | 3/2000 | Boehme | F24D 3/08 | 138/26 |
| 7,445,616 | B2 * | 11/2008 | Petrakis | 604/890.1 | |
| 8,944,109 | B2 * | 2/2015 | Mueller | F24D 3/1016 | 138/26 |
| 2004/0139929 | A1 * | 7/2004 | Nightlinger et al. | 122/14.2 | |
| 2007/0186873 | A1 * | 8/2007 | Polkhouskiy | F24D 3/1016 | 122/14.2 |
| 2008/0035647 | A1 * | 2/2008 | Fuller | F24D 3/1016 | 220/530 |
| 2008/0179333 | A1 * | 7/2008 | Fuller | F24D 3/1016 | 220/530 |
| 2012/0227705 | A1 * | 9/2012 | Ashizawa | 123/435 | |

FOREIGN PATENT DOCUMENTS

| | | | |
|---|---|---|---|
| DE | 3544754 | A1 | 6/1987 |
| DE | 8806097 | U1 | 10/1988 |
| DE | 9201768 | U1 | 4/1992 |
| DE | 10233481 | A1 * | 2/2004 |
| DE | 10347884 | B3 | 6/2005 |
| JP | 3-117853 | | 5/1991 |
| JP | 6-40754 | | 5/1994 |

OTHER PUBLICATIONS

International Search Report issued in International Application No. PCT/NL2009/050321, mailed on May 7, 2010.

* cited by examiner

HOT WATER HEATER AND METHOD OF SUPPLYING HOT WATER

CROSS-REFERENCE AND PRIORITY CLAIM TO RELATED APPLICATIONS

This application is a national stage application under 35 U.S.C. §371 of PCT/NL2009/050321, filed Jun. 10, 2009, published as WO 2009/151321 A2 on Dec. 17, 2009, and claiming priority to Dutch Patent Application No. NL2001674, filed Jun. 12, 2008, which application and publication is incorporated herein by reference and made a part hereof in its entirety, and the benefit of priority of which is claimed herein.

The invention relates to a hot water heater comprising at least one hot water tank, a supply pipe to be connected to the public water mains and a discharge pipe to be connected to a tap, which hot water tank has at least one wall which encloses at least part of the interior of the tank, and which is provided with a heating element disposed inside the hot water tank and with a temperature control device.

In hot water heaters, water from the water mains is heated to the desired temperature. As a result of said heating, expansion of the water takes place, which expansion may amount to 2-5%. This expansion volume of water must go somewhere. Depending on the type of hot water heater, the prior art offers various solutions in this regard. A distinction must be made in this connection between pressureless (atmospheric) heaters and heaters provided with pressure tanks. National installation regulations need to be considered when attempting to solve the expansion problem.

Atmospheric hot water heaters usually have a valve on the inlet side, so that the hot outlet is open. In many cases, the hot expansion water is allowed to leak out via the outlet, which is a simple but not very elegant solution. A dripping tap is annoying to the user and leads to a waste of water and (heating) energy.

Atmospheric hot water heaters have the drawback that the tank is provided with a vent hole, through which water vapour can escape. For that reason, such heaters are less suitable for the storage of water at temperatures in excess of 80° C. The hot water heaters must be installed in a properly ventilated room, therefore.

When pressure tanks are used for the storage of hot water, as in the present invention, various expansion systems are used.

In a first system, use is made of a non-return valve, an overflow valve and an overflow funnel ("inlet combination"). The overflow valve is mounted in the cold water supply pipe directly before the tank. When a predetermined pressure, which is higher than the maximum water supply pressure, is exceeded, said valve will open, after which the expansion water will drain away via an open connection and a funnel-shaped member, which generally opens into a drain pipe. This solution has the following drawbacks: 1) The open connection with the drain may cause an overflow in case of an obstruction in a water drain pipe, for example in a kitchen cabinet. 2) Depending on the hot water temperature, 2-5% water is wasted. 3) During every heating cycle, the pressure in the tank of necessity rises above the maximum water supply pressure. 4) The provision of the expansion water drain involves an extra installation effort and takes place at the expense of the available space in the cabinet.

In a second system, a non-return valve and an expansion tank are installed before the cold water inlet. When heating takes place, the expansion water will find its way into the expansion tank. This has the following consequences: 1) The membrane (of EPDM or butyl rubber) which provides the separation between gas and water is not fully gastight, as a result of which the tank must be periodically pressurised. 2) A fairly large additional component needs to be installed, which adds to the cost and which requires space. 3) Throughflow of the water in the expansion tank is not ensured (one supply pipe), which, under certain conditions, might lead to bacterial growth.

Consequently, this solution is not unconditionally acceptable for hot water applications. In addition to that, the service aspect constitutes a major drawback.

In a third system, an internal air chamber is utilised for collecting expansion water. According to this system, a volume of air is trapped at the top of the hot water tank as a solution to the drawbacks of allowing expansion water to drain away or collecting it externally. The outlet channel extends so far downwards in the boiler that a sufficiently large volume of air is compressed to the reduced water supply pressure when the tank is being filled. When the water is being heated, the expansion tank will compress the trapped air. As a result, the air pressure—and thus the pressure in the tank—will increase. The pressure will further increase as a result of the air being heated. Finally, the pressure inside the expansion chamber will increase as a result of the significant pressure of the saturated water vapour above the hot water. These three factors may lead to strongly increasing pressures upon initial heating of the tank. The only way to limit the end pressure is to use a relatively large air space, so that the compression caused by the heating of the water is reduced. A large air chamber, however, can only be realised by having the hot water outlet extend even further into the boiler so as to achieve the required (cold) air compression. The necessity of initial compression of cold air so as to create an expansion buffer is the main problem of the "air bubble" expansion systems. The consequence is that when water is being tapped, a significant part of the hot water cannot be tapped. At storage temperatures higher than 75° C., this will be a significant drawback.

Another problem is the fact that no separation exists between gas (air/water vapour) and water, so that the amount of air can increase or decrease. An increase of the amount of air may eventually lead to air escaping when the tap is being opened, whilst a decrease of the amount of air may lead to an overpressure in the boiler when heating takes place.

Furthermore, the internal air/vapour bubble leads to an increased corrosion risk on account of the combination of a high temperature with water vapour and oxygen and a fluctuating liquid level.

DE 8806097 U1 discloses a hot water heater for the storage of hot water for household use, which comprises a membrane of rubber or other elastic material, wherein a gas chamber is formed between the membrane and the cover of the tank or the tank wall for taking up the volume increase of the water when the water is being heated.

DE 3040450 A1 discloses a pressureless hot water tank, whose wall may be provided with deformable pleats. The pleats are provided with bimetal layers, which actively cause deformation of the pleats in case of a change in temperature, thereby effecting a change of the tank volume. In another embodiment, the tank is provided with a compression bar provided with bimetal pleats which can cause the tank to expand or contract in case of a temperature change.

The object of the invention is to avoid the drawbacks of the known hot water heaters as much as possible and to provide a new hot water heater which is preferably easy to install and which is of compact construction.

In order to accomplish that object, the hot water heater according to the invention is characterised in that the wall of the tank comprises at least a wall part which is configured to be deformable under pressure, thus enabling the tank to expand and contract, which deformable part of the tank wall is operatively connected to, and preferably surrounded by, a gas chamber containing a gas under pressure, which is capable of balancing the expansion of the tank.

The use of the hot water heater according to the invention solves the problems of the air-vapour bubble expansion chamber to a significant extent, because use is now made of a tank which cooperates with a fixed gas chamber. This has the following advantages:

1) The entire volume of the tank can be tapped, because the tank can be completely filled with water.
2) There is no pressure increase caused by water vapour.
3) The amount of gas is constant, because the gas is trapped in a separate gas chamber and is separated from the water, therefore.

Although the gas chamber may be connected to the deformable part of the tank wall via a piston or the like, it is advantageous to have this deformable part directly surrounded by a gas chamber, because this leads to a simpler and more compact construction.

It is advantageous if the deformable part comprises deformable pleats or (zigzag) folds, because it is possible in that case to use a material which is capable of deforming at the operating pressures of the hot water heater but which is non-stretchable.

The tank preferably comprises a cylindrical circumferential wall having a longitudinal axis and two end walls, wherein either the circumferential wall of the tank comprises the deformable part near at least one of said end walls, in which deformable part the pleats or folds form a bellows or accordion so as to enable the tank to expand and contract in the direction of the longitudinal axis, wherein the bellows part of the circumferential wall and the adjacent end wall are surrounded by the gas chamber, or wherein at least one of said side walls is provided with the deformable part and surrounded by the gas chamber.

In this way an easily deformable bellows part is formed, which allows an easily controllable expansion and contraction with relatively large volume changes without the use of a stretchable material being required.

Thus, the deformable part of the wall, and preferably the entire wall, may be made of a metal, in particular stainless steel, which may be made in one piece and which may have a wall thickness of about 0.6 mm or less, preferably about 0.4 mm.

The deformable part of the tank wall is preferably designed to allow a maximum expansion of the tank of about at most 10%, preferably at most 5%, of its unexpanded volume. In most cases this suffices for taking up the expansion of the water heating up inside the tank.

The tank is preferably provided with a stop for limiting at least the contraction movements of the deformable part of the tank wall, which stop may be disposed on the inner side of the gas chamber wall, for example, in particular on the circumferential wall of the gas chamber, and which can mate with at least one pleat of the bellows part.

In this way the minimum volume of the tank is established and from there the expansion of the tank through expansion of the water can take place in a predictable manner.

In its unloaded condition, the bellows part can have a length which ranges between the extreme lengths of the bellows part in use, preferably a length approximately midway between said extreme lengths.

As a result, the load to which the bellows part is subjected will be low during normal use, since the bellows part does not move far from the position it takes up in the unloaded condition and because it is not loaded heavily, if at all, in the stationary condition.

The volume of the gas chamber may be about 10-50%, preferably 10-25%, of the volume of the tank in the unexpanded condition. As a result of this relatively small volume, the total volume of the hot water heater is only increased to a small extent by the gas chamber.

In a preferred embodiment of the hot water heater according to the invention, the heating element and the temperature control device are designed to heat the water to a temperature of more than 100° C. under super-atmospheric pressure conditions.

The hot water heater is thus suitable for directly supplying boiling water.

The invention also relates to a method for supplying hot water, using a hot water heater which comprises at least one expandable tank provided with a supply pipe, which is connected to the public water mains, and a discharge pipe, which is connected to a tap. According to the invention, the method comprises the steps of:

1) supplying water from the water mains to the tank until the unexpanded tank is completely filled with cold water,
2) heating the water in the tank to a temperature of preferably 100° C. or higher, causing the volume of the water to increase and the tank to expand,
3) successively tapping amounts of water by means of the tap, resulting in the gas pressure compressing the tank to its contracted condition again, and
4) replenishing and heating the water in the tank again, causing the tank to expand to an extent which depends on the amount of water that has been tapped.

The invention will now be explained in more detail with reference to drawings, which show embodiments of the hot water heater according to the invention.

Figure 1:
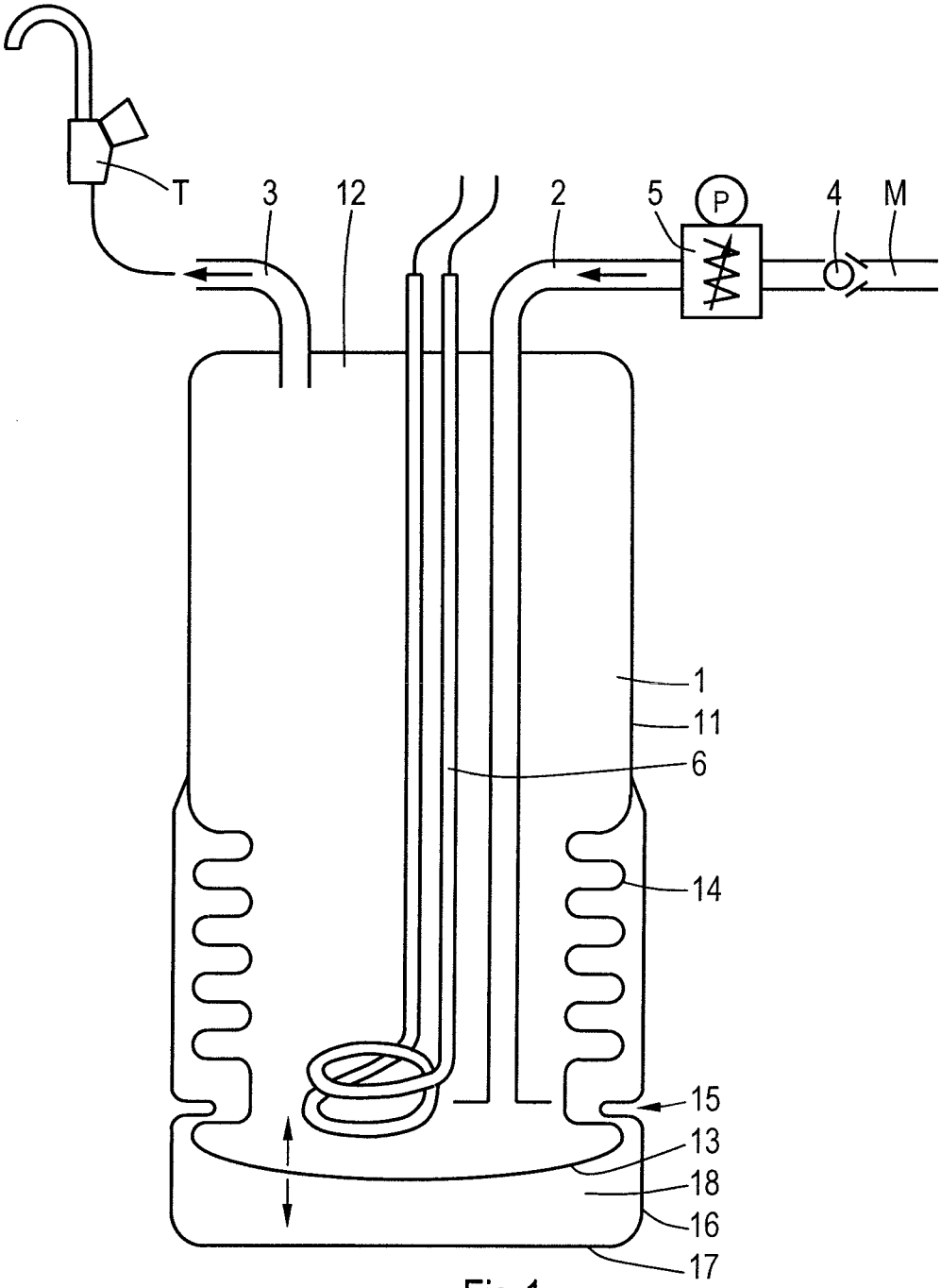
FIG. 1 is a schematic view of an example of the hot water heater according to the invention.

FIG. 1 schematically shows a possible embodiment of a hot water heater. The heater comprises a hot water tank 1, a supply pipe 2, which can be connected to the public water mains M, as well as a discharge pipe 3, which can be connected to a tap T. The supply pipe 2 is provided with a non-return valve/pressure reducing valve 4, 5 for controlling the pressure in the tank 1 when water is being supplied from the water mains M. The hot water heater is furthermore provided with a heating element 6.

The tank 1 of the hot water heater has a circumferential wall 11, an upper wall 12 and a bottom wall 13. In this embodiment, a part 14, in this case the lower part, of the circumferential wall 11 is shaped so that it is capable of elastic deformation under pressure in the tank 1, thus enabling the tank 1 to expand and contract. In this embodiment, said part 14 is configured with deformable corrugations or pleats, i.e. it is bellows-shaped. In this embodiment the bellows-shaped part 14 takes up slightly less than half the length of the circumferential wall 11 in undeformed condition (for example about 30% to 40-50%), and the bellows-shaped part is designed to be capable of taking up a volume increase of 5-10% of the water in the tank. The bellows-shaped part extends around a part of the heating element and forms an integral part of the tank 1. The contraction and possibly expansion of the bellows-shaped part of the tank 1 can be limited by a stop 15, which mates with at least one of the pleats, in this case the lowermost pleat 14' of the bellows-shaped part 14, which will come to abut against the stop 15 upon contraction of the bellows-shaped part 14.

In this embodiment, the annular (in this case) stop 15 is formed in a circumferential wall 16, which bounds a gas chamber 18, in particular air chamber, together with an end wall 17, which chamber surrounds the bellows-shaped part 14 and the bottom wall 13 of the tank 1. The circumferential wall 16 of the gas chamber 18 is fixed to the circumferential wall 11 of the tank 1, for example by welding, at a location just above the bellows-shaped part 14. In this way the gas chamber wall 16, 17 forms a stationary unit with the tank 1, which is practically non-deformable in use, and the bellows-shaped part 14 is movable relative to the gas chamber wall 16, 17. As a result, the volume of the gas chamber 18 will increase or decrease upon contraction or expansion of the bellows-shaped part 14, and the gas chamber 14 can function as a gas spring for the hot water tank 1, because the pressure in the gas chamber 18 exerts a force on the bottom wall 13 of the tank 1, and thus biases the bellows-shaped part 14 to a contracted condition. The degree of contraction or expansion of the bellows-shaped part 14 of the tank 1 will depend on the balance between the pressure (and the weight) of the water in the tank 1 on the one hand and the pressure in the gas chamber 18 and the rigidity of the bellows-shaped part on the other hand. It is advantageous in that regard if the spring constant of the bellows-shaped part 14 is relatively small, because a more flexible bellows leads to a lower maximum pressure in the tank than a more rigid bellows. The volume of the gas chamber may for example be about 10-50%, preferably 10-25%, of the volume of the tank 1 in the unexpanded condition thereof.

The bellows-shaped part 14 and preferably the entire circumferential wall 11 of the tank 1 can be formed of one piece of stainless steel, which may have a wall thickness of about 0.6 mm or less, preferably 0.4 mm. The circumferential wall of the tank can for example be made by hydro forming. The choice of stainless steel is especially prompted by the hygienic properties of this metal, which render it very suitable for using the hot water heater for drinking water. The bellows-shaped part 14 is preferably designed so that its length in unloaded condition ranges between the extreme lengths of the bellows part 14 in use, preferably about midway between said extreme lengths. This means that if the lowermost pleat 14' of the bellows part 14 abuts against the stop 15, and the pressure inside the tank 1 amounts to (practically) zero, the bellows part 14 will be compressed by the pressure in the gas chamber 18, against the spring pressure. Upon expansion of the bellows part 14 caused by the heating of the water, and thus the increase of the pressure inside the tank, the bellows part 14 will initially relax and then be expanded against the spring pressure after passing the unloaded point.

The operation of the hot water heater shown in FIG. 1 is as follows.

When the hot water heater is placed into service, the tank 1 will be completely filled with water from the water mains, at which point the water in the tank 1 and the air in the gas chamber 18 will be cold, normally having a temperature of 10-20° C. As a consequence of this low temperature, the force exerted on the bottom wall 13 of the tank 1 by the air in the gas chamber 18 will be about 25% smaller than in the normal condition of use, in which the temperature of the water and the air will be about 110° C. The bellows-shaped part 14 is then in the position in which the lowermost pleat abuts against the stop 15 and the volume of the tank 1 is minimal, therefore. As a result, a maximum expansion of the bellows-shaped part 14 and thus of the tank 1 is possible. The pressure in the gas chamber 18 opposes the pressure of the water in the tank 1 as well as the pressure of the slightly compressed bellows-shaped part 14.

When the water in the tank 1 is heated by means of the heating element 6, the water will expand, causing the volume to increase and the bellows-shaped part 14 to expand. As a result, the bottom wall 13 of the tank 1 will move downwards and the pressure inside the gas chamber 18 will increase on account of the volume decrease thereof and the temperature increase of the error in the gas chamber 18. The bottom wall 13 of the tank 1 will keep adjusting its position so as to maintain force equilibrium. In practice, the bellows part 14 will not expand so far that the second pleat comes into contact with the stop 15 in the normal condition of use. After all, in a situation where the tank 1 cannot expand any further whilst on the other hand the water inside the tank 1 actually expands, the pressures inside the tank 1 can reach very high levels, which situation must be avoided, of course.

The volume of the water in the tank 1 will be largest after the tank has been completely filled with cold water and said cold water is subsequently heated, because then the difference between the average starting and end temperatures will be greatest.

When the tap T is opened for the first time after the hot water heater has been placed into service, the water pressure will drop to a pressure in the vicinity of the reduced water mains pressure when the expansion volume (in the case of a 3 l tank this will typically be about 125 ml) has flowed through the tap T and the bellows-shaped part has returned to its uppermost position, in which it abuts against the stop 15. After closing of the tap T, the downward force on the bottom wall 13 of the tank 1 will slightly increase as a result of the action of the pressure reducing valve, but also in this situation the bellows-shaped part will remain in contact with the stop 15, because the pressure of the heated air in the gas chamber 18 is considerably higher, about 25-30%, than in the cold condition.

The newly supplied cold water will now be heated by the heating element 6. Depending on the amount of hot water discharged through the tap T (and thus the amount of cold water being supplied), the water in the tank 1 will expand to a greater or smaller extent as a result of said heating, but it stands to reason that the extent of said expansion will at all times be less than in the case that the entire tank is filled with cold water. Consequently, the expansion of the bellows-shaped part 14 will stay below the maximum. This cycle will repeat itself each time water is tapped from the tank 1 and the water in the tank is replenished.

Figure 2:
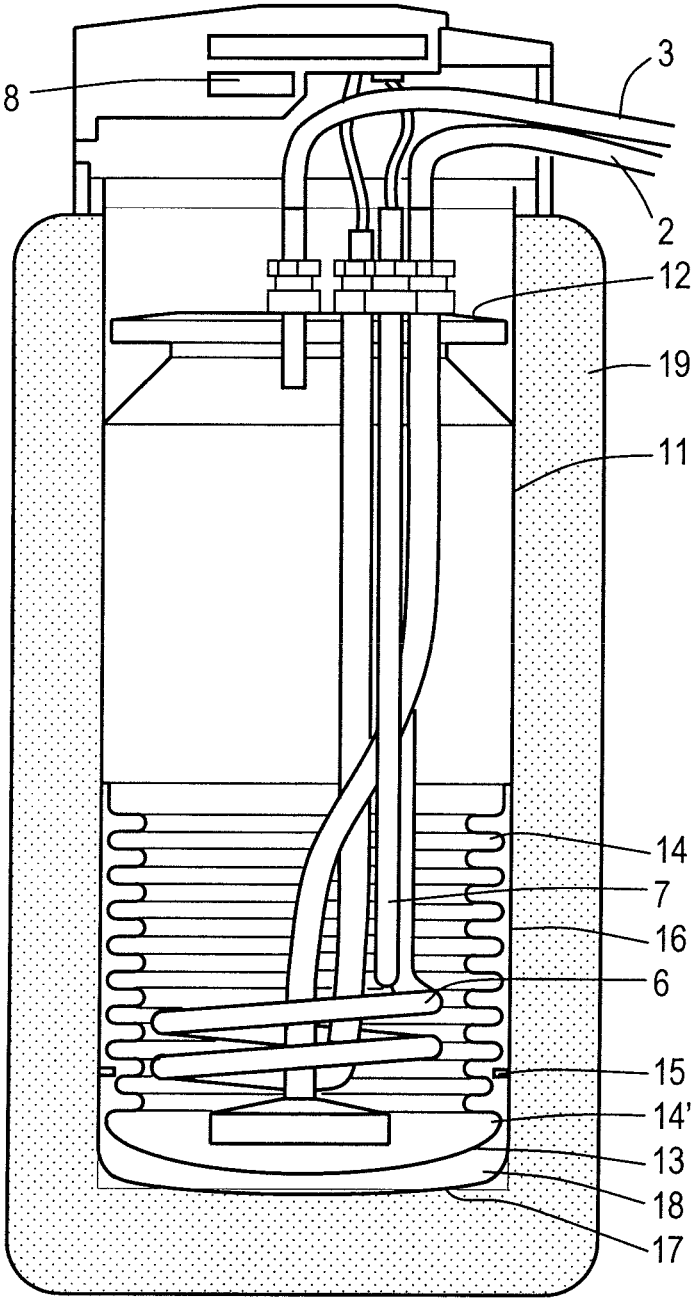
FIG. 2 is a sectional view of a possible embodiment of the hot water heater of FIG. 1.

FIG. 2 shows a practical embodiment of the hot water heater of FIG. 1, which is provided with a temperature sensor 7 with an electronic temperature control device 8, by which the temperature of the water in the tank 1 is thermostatically controlled. The upper wall 12 of the tank 1 is formed by a cover which is fastened to a flange of the tank by fasteners, such as bolts. When the cover is removed, the temperature sensor 7, the heating element 6 and the supply and discharge lines 3, 4 attached thereto are also removed from the tank. The figure furthermore shows that the circumferential wall 16 of the gas chamber 18 smoothly abuts the upper part of the circumferential wall of the tank 1, so that a smooth outer side of the tank 1 is obtained. This makes it possible to configure the tank with vacuum insulation, as disclosed in U.S. Pat. No.

6,612,268 B1, whose contents are incorporated herein by reference. For the sake of simplicity, the insulation of the tank 1 is shown in the form of insulation material 19.

Figure 3:
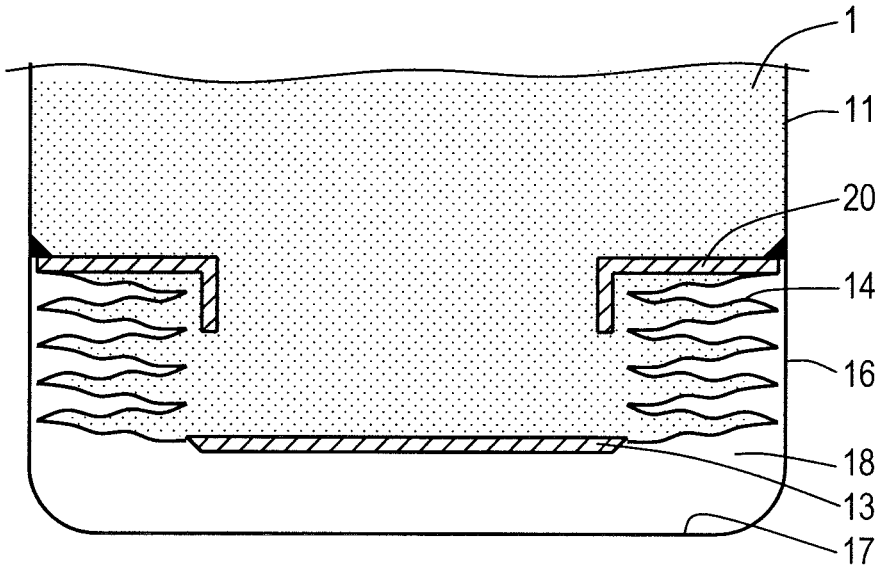
FIGS. 3 and 4 are very schematic sectional views of the deformable wall part of a tank of another example of the hot water heater according to the invention, shown in two different states of expansion.
Figure 4:
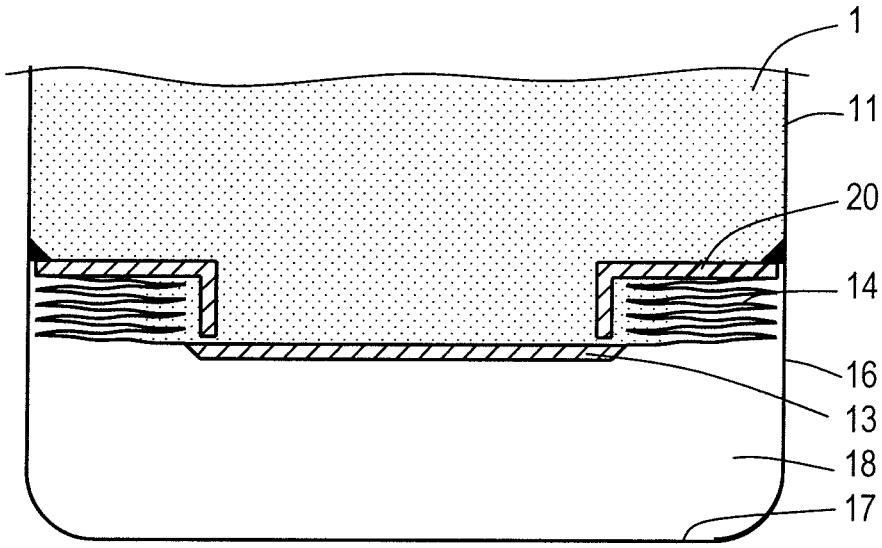

FIGS. 3 and 4 very schematically show another embodiment of the hot water heater according to the invention, in particular the deformable part of the wall of the tank 1. FIGS. 3 and 4 show the circumferential wall 11 of the tank 1, the bottom wall 13 of the tank 1 and the circumferential wall 16 and the bottom wall 17 of the gas chamber 18. In this case an annular cross bulkhead 20 is mounted in the tank 1, to which the deformable wall part 14 is attached, which wall part is accordion-shaped in this case. In the compressed condition, the accordion-shaped wall part 14 abuts against the cross bulkhead 20, which functions as a stop. Said accordion-shaped wall part 14 may also be made of a metal, in particular stainless steel, which can readily be formed and welded and which is furthermore very corrosion resistant. The segments of the accordion may be made up of segments measuring 2×0.25 mm, which provide the required pressure resistance (for example 3 bar pressure difference between the inside and the outside). The volume of the gas chamber 18 may be about 450 ml, in which case the deformable part 14 is capable of providing an expansion volume of 150 ml when using a tank having a capacity of 3 L (the difference between the position shown in FIG. 3 and the position shown in FIG. 4).

Figure 5:
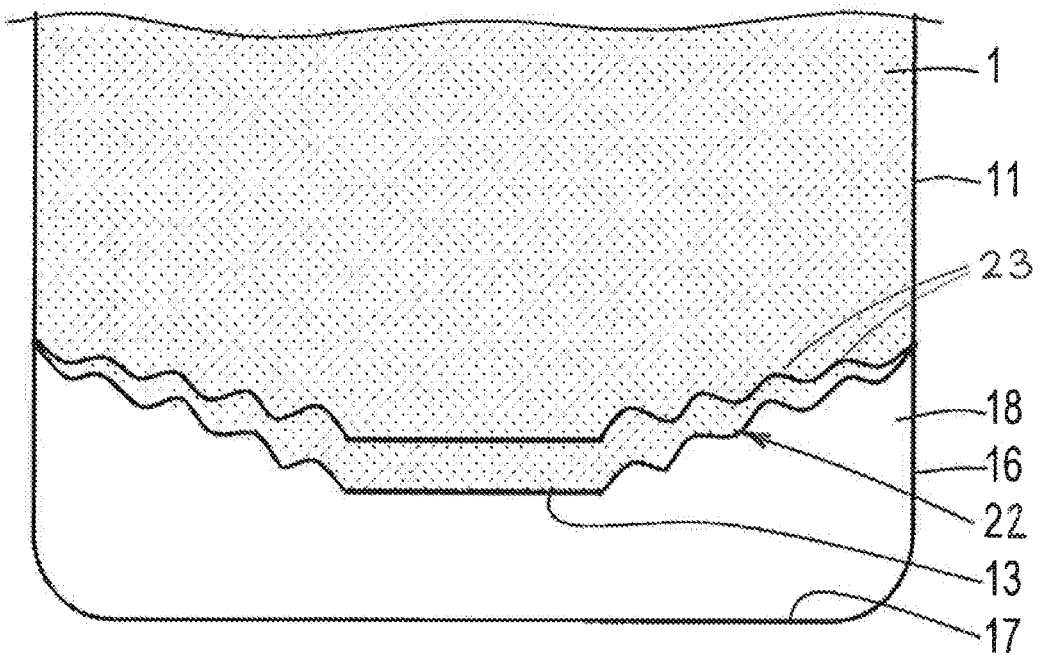
FIG. 5 is a very schematic sectional view of another example of the deformable wall part of a tank of the hot water heater according to the invention.

FIG. 5 very schematically shows another embodiment of a deformable wall part, in which in this case the bottom wall 13 of the tank 1 has a deformable wall part 22. In this embodiment, the deformable wall part 22 has circular pleats 23, as are also found in the bottom of a can; in this case the pleats are more pronounced, however, so as to enable the tank 1 to expand and contract. FIG. 5 shows the bottom wall 13 in two different positions, with different states of deformation of the deformable part 22, which moves in a direction parallel to the central axis of the cylindrical tank. At least the centre of the bottom wall must be operatively connected to the gas chamber. In this case the entire bottom wall is surrounded by the gas chamber.

From the foregoing it will be apparent that the invention provides a hot water heater which is remarkable for its simplicity and compactness. Furthermore, no expansion water is lost, so that the hot water heater is economical in use. The normal operation of the hot water heater and the efficiency thereof are not adversely affected by the aspects according to the invention, whilst also the level of hygiene remains ensured. The aspects according to the invention can in particular be implemented very well in an appliance which supplies boiling water, for example in the kitchen, where the appliance is disposed in the kitchen cabinet under the sink.

The invention is not limited to the embodiments as shown in the drawing and described above, which can be varied without departing from the scope of the invention. Thus, the deformable wall part of the embodiments shown and described herein is made of a material which is elastically deformable, but which is in principle non-stretchable during use, so that the expansion is not effected (only) by deformation of the tank, but (also) as a result of the material stretching.

In the case of a non-stretchable material and a cylindrical tank, the expansion will for the major part take place in the direction parallel to the central axis of the tank, so that the respective end wall which moves (entirely or the central part thereof) will be operatively connected to the gas chamber or be surrounded thereby). As already said before, the deformable part is shaped and constructed so that the spring constant, and thus the required deformation force, is relatively low, and consequently the balancing force for the water pressure is mainly generated by the gas pressure.

At or before the tap T, or at another tapping point, the hot water from the hot water heater can be mixed with cold water, so that water of any desired temperature can be obtained from the hot water heater.

The invention claimed is:

1. A hot water heater comprising:

at least one hot water tank;

a heating element disposed inside the hot water tank;

a temperature control device operably connected to the heating element;

a supply pipe configured to be connected to a public water mains; and a discharge pipe configured to be connected to a tap;

wherein:

the hot water tank comprises a cylindrical circumferential wall having a longitudinal axis and at least one end wall which enclose at least part of an interior of the tank;

the cylindrical circumferential wall of the tank comprises at least a deformable wall part which is configured to be deformable under pressure, enabling the tank to expand and contract, the deformable wall part of the tank wall comprising deformable pleats forming a bellows part near the at least one end wall so as to enable the tank to expand and contract in a direction of the longitudinal axis, wherein the bellows part and the at least one end wall are surrounded by a gas chamber containing a gas under pressure, which is configured to balance the expansion of the tank.

2. The hot water heater according to claim 1, wherein at least the deformable part of the wall is made of a corrosion-resistant metal and is made in one piece and have a wall thickness of maximally about 0.6 mm.

3. The hot water heater according to claim 1, wherein the gas chamber is formed between the hot water tank and a gas chamber wall which comprises at least an end wall and a circumferential wall of the gas chamber.

4. The hot water heater according to claim 3, wherein the circumferential wall of the gas chamber is attached to the circumferential wall of the hot water tank at its end remote from the end wall of the gas chamber, adjacent to an end of the deformable part remote from the at least one end wall of the tank.

5. The hot water heater according to claim 1, wherein the deformable part of the tank wall is designed to allow a maximum expansion of the tank of about at most 10% of its unexpanded volume.

6. The hot water heater according to claim 1, wherein tank is provided with a stop configured to limit at least the contraction movements of the deformable part of the tank wall.

7. The hot water heater according to claim 6, wherein said stop is disposed on an inner side of a gas chamber wall, in particular on a circumferential wall of the gas chamber, and which mates with at least one pleat of the bellows part.

8. The hot water heater according to claim 1, wherein the supply pipe is provided with a pressure reducing valve configured to control the pressure in the tank.

9. The hot water heater according claim 1, wherein the bellows part, in an unloaded condition thereof, has a length which ranges between the extreme lengths of the bellows part in use.

10. The hot water heater according to claim 1, wherein the bellows part takes up about 30-50% of the total length of the circumferential wall in an unexpanded condition.

11. The hot water heater according to claim 1, wherein the volume of the gas chamber is about 10-50% of the volume of the tank in an unexpanded condition.

12. The hot water heater according to claim 1, wherein the heating element and the temperature control device are designed to heat the water to a temperature of more than 100° C. under super-atmospheric pressure conditions.

13. The hot water heater according to claim 1, wherein the end wall of the tank adjacent to the bellows part forms the bottom wall of the tank.

14. The hot water heater according to claim 1, wherein the heating element extends into that part of the tank which is surrounded by the gas chamber.

15. A hot water heater comprising:

a hot water pressure tank;

a heating element disposed inside the hot water tank;

a temperature control device operably connected to the heating element;

a supply pipe configured to be connected to a public water mains for admitting mains water under pressure to the hot water pressure tank and heating and storing said water therein at a temperature of at least 80° C.; and a discharge pipe configured to be connected to a drinking water tap;

wherein:

the hot water tank has at least one wall which is substantially made of a corrosion-resistant metal and which comprises at least one cylindrical wall formed around a central axis, which cylindrical wall encloses at least part of the interior of the tank;

the cylindrical wall of the tank comprises a wall part near an end of the tank which is provided with deformable pleats configured to deform in a direction parallel to the central axis under pressure of the water in the tank, thus enabling the tank to expand and contract; and the deformable part of the cylindrical tank wall and the adjacent end wall of the tank are operatively surrounded by a gas chamber containing a gas under pressure, which is configured to balance the expansion of the tank.

16. A hot water heater comprising:

at least one hot water tank;

a heating element disposed inside the hot water tank;

a temperature control device operably connected to the heating element;

a supply pipe configured to be connected to a public water mains; and a discharge pipe configured to be connected to a tap;

wherein:

the hot water tank comprises a cylindrical circumferential wall having a longitudinal axis and at least one end wall which enclose at least part of an interior of the tank;

the cylindrical circumferential wall of the tank comprises at least a deformable wall part which is configured to be deformable under pressure, enabling the tank to expand and contract, the deformable wall part of the tank wall comprising deformable pleats forming a bellows part near the at least one end wall so as to enable the tank to expand and contract in a direction of the longitudinal axis, wherein the bellows part and the at least one end wall are surrounded by a gas chamber containing a gas under pressure, which is configured to balance the expansion of the tank;

the gas chamber is formed between the hot water tank and a gas chamber wall which comprises at least an end wall and a circumferential wall of the gas chamber, the circumferential wall of the gas chamber being attached to the circumferential wall of the hot water tank at its end remote from the end wall of the gas chamber, and being located remote from the at least one end wall of the tank.

* * * * *